US009318056B2

(12) United States Patent
Nurmi et al.

(10) Patent No.: US 9,318,056 B2
(45) Date of Patent: Apr. 19, 2016

(54) APPARATUS, DISPLAY MODULE AND METHODS FOR CONTROLLING THE LOADING OF FRAMES TO A DISPLAY MODULE

(75) Inventors: Juha Harri-Pekka Nurmi, Salo (FI); Kaj Saarinen, Beijing (CN); Tero Rautanen, Jyväskylä (FI)

(73) Assignee: Nokia Technologies Oy, Espoo (FI)

( * ) Notice: Subject to any disclaimer, the term of this patent is extended or adjusted under 35 U.S.C. 154(b) by 684 days.

(21) Appl. No.: 13/580,720

(22) PCT Filed: Feb. 25, 2010

(86) PCT No.: PCT/IB2010/050834

§ 371 (c)(1),
(2), (4) Date: Sep. 18, 2012

(87) PCT Pub. No.: WO2011/104582

PCT Pub. Date: Sep. 1, 2011

(65) Prior Publication Data

US 2013/0009974 A1 Jan. 10, 2013

(51) Int. Cl.

| | |
|---|---|
| ***G09G 3/36*** | (2006.01) |
| ***G09G 3/34*** | (2006.01) |
| ***G09G 5/399*** | (2006.01) |
| *G09G 5/39* | (2006.01) |

(52) U.S. Cl.

CPC ..... *G09G 3/3406* (2013.01); *G09G 5/399* (2013.01); *G09G 5/39* (2013.01); *G09G 2310/0237* (2013.01); *G09G 2310/061* (2013.01); *G09G 2320/064* (2013.01)

(58) Field of Classification Search

CPC ..... G09G 3/3406; G09G 2310/061; G09G 2310/0237; G09G 2320/064; G06G 5/39; G06G 5/399

USPC ..... 345/98–103, 204, 1.1–2.3

See application file for complete search history.

(56) References Cited

U.S. PATENT DOCUMENTS

| | | | | |
|---|---|---|---|---|
| 5,459,477 | A * | 10/1995 | Fukuda et al. | 345/2.1 |
| 5,543,824 | A | 8/1996 | Priem et al. | 345/201 |
| 5,929,832 | A | 7/1999 | Furukawa et al. | 345/98 |
| 5,956,046 | A | 9/1999 | Kehlet et al. | 345/502 |
| 6,166,712 | A | 12/2000 | Hoffman et al. | 345/87 |
| 6,664,968 | B2 | 12/2003 | Ono | 345/532 |
| 6,885,377 | B2 | 4/2005 | Lim et al. | 345/539 |
| 7,477,205 | B1 | 1/2009 | De Waal et al. | 345/1.3 |
| 2003/0179221 | A1 * | 9/2003 | Nitta et al. | 345/690 |
| 2005/0195206 | A1 | 9/2005 | Wogsberg | 345/547 |
| 2006/0114219 | A1 | 6/2006 | Park | 345/102 |

FOREIGN PATENT DOCUMENTS

| | | | |
|---|---|---|---|
| EP | 0 312 720 | A2 | 4/1989 |
| EP | 0 492 938 | A2 | 7/1992 |
| EP | 1 534 002 | A1 | 5/2005 |
| EP | 1 895 489 | A2 | 3/2008 |
| WO | WO 97/08626 | | 3/1997 |
| WO | WO 2004/004318 | A1 | 1/2004 |
| WO | WO 2007/112019 | A2 | 10/2007 |

* cited by examiner

*Primary Examiner* — Jimmy H Nguyen

(74) *Attorney, Agent, or Firm* — Harrington & Smith

(57) ABSTRACT

Apparatus including: a controller; a display panel; a first frame memory configured to load a frame of data to the display panel during insertion of a blank frame at the display panel and configured to be filled by a frame of data from the controller, wherein the controller is configured to insert blank frames between frames of data displayed on the display panel.

19 Claims, 7 Drawing Sheets

APPARATUS, DISPLAY MODULE AND METHODS FOR CONTROLLING THE LOADING OF FRAMES TO A DISPLAY MODULE

FIELD OF THE INVENTION

Embodiments of the present invention relate to an apparatus, a display module, or a method, for example.

BACKGROUND TO THE INVENTION

A frame of data may be used to fill a frame memory. The frame memory may then be used to load the frame of data into a display panel. The frame memory acts as a buffer.

It is important that the frame of data is not transferred to the frame memory in a way that results in the display panel displaying parts of two adjacent but different frames of data in a single image frame. It is important that the filling of the frame memory does not catch and overtake the loading of data from the frame memory or visa versa. To prevent this a signal (Tearing Effect Output Line) may be provided from the frame memory to the controller.

If more than one display panel is used it may be necessary for the controller to consider TE signals for each display panel

BRIEF DESCRIPTION OF VARIOUS EMBODIMENTS OF THE INVENTION

According to various, but not necessarily all, embodiments of the invention there is provided an apparatus comprising: a controller; a display panel; a first frame memory configured to load a frame of data to the display panel during insertion of a blank frame at the display panel and configured to be filled by a frame of data from the controller, wherein the controller is configured to insert blank frames between frames of data displayed on the display panel.

According to various, but not necessarily all, embodiments of the invention there is provided a display module comprising: a display panel; a first frame memory configured to be filled by a frame of data from an input interface and configured to load a frame of data to the display panel, and a second frame memory configured to be filled by a frame of data from an input interface and configured to load a frame of data to the display panel, and configured so that whichever of the first frame memory and the second frame memory that has been most recently filled by a complete frame of data, loads a next frame of data to the display panel.

According to various, but not necessarily all, embodiments of the invention there is provided an apparatus comprising: one or more display modules, wherein each display module is configured to load a frame of data only during insertion of a blank frame; and one or more controllers configured to synchronously insert, for each display panel(s), a blank frame between frames of data displayed on the display panels.

According to various, but not necessarily all, embodiments of the invention there is provided a method comprising: displaying a first frame of data previously loaded into a display panel; displaying a blank frame at the display panel and simultaneously loading a second frame of data into the display panel; and displaying the second frame of data now loaded into the display panel According to various, but not necessarily all, embodiments of the invention there is provided a method comprising: displaying a blank frame at a display panel and simultaneously loading a first frame of data into the display panel; displaying the first frame of data now loaded into a display panel; displaying a blank frame at the display panel and simultaneously loading a second frame of data into the display panel; and displaying the second frame of data now loaded into the display panel According to various, but not necessarily all, embodiments of the invention there is provided a method comprising: receiving frames of data; displaying a blank frame at the display panel and simultaneously loading a most recently received complete frame of data into the display panel; and displaying the loaded frame of data.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
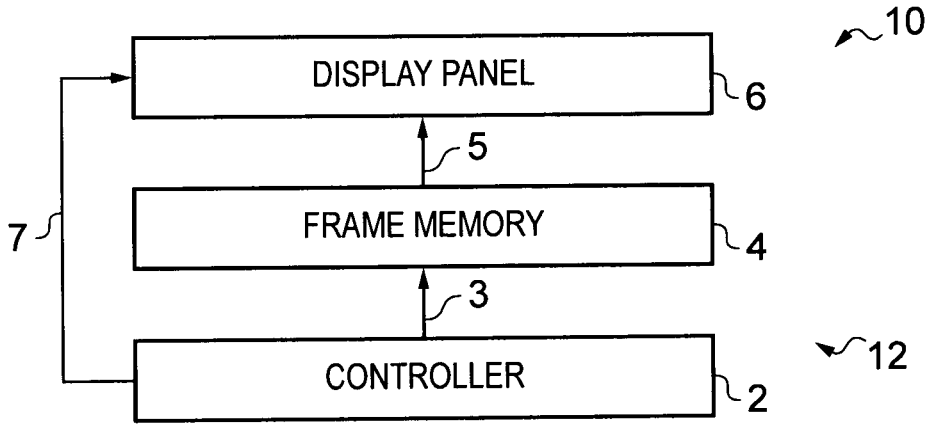
FIG. 1 schematically illustrates an apparatus configured to load a frame of data to a display panel during insertion of a blank frame at the display panel.

In the following description the transfer of data to a frame memory will be described and the transfer of data from a frame memory will be described. For clarity of description, the term 'fill' will be used to denote transfer of data to a frame memory and the term 'load' will be used to denote transfer of data from a frame memory. No other special technical meaning is intended merely by the use of different terms to denote the transfer of data.

The Figures schematically illustrates an apparatus 10 comprising: a controller 2; a display panel 6; and a frame memory 4 configured to load a frame of data $\mathbf{5}_N$ to the display panel 6 during insertion of a blank frame 11 at the display panel 6 and configured to be filled by a frame of data 3 from the controller 2, wherein the controller 2 is configured to insert blank frames 11 between frames of data 5 displayed on the display panel 6.

The apparatus 10 may be an electronic apparatus or a module for an electronic apparatus. The apparatus 10 may, for example, be a hand portable apparatus. It may, for example, be a mobile cellular telephone or a personal music, video or computing device or a digital camera.

Figure 2:
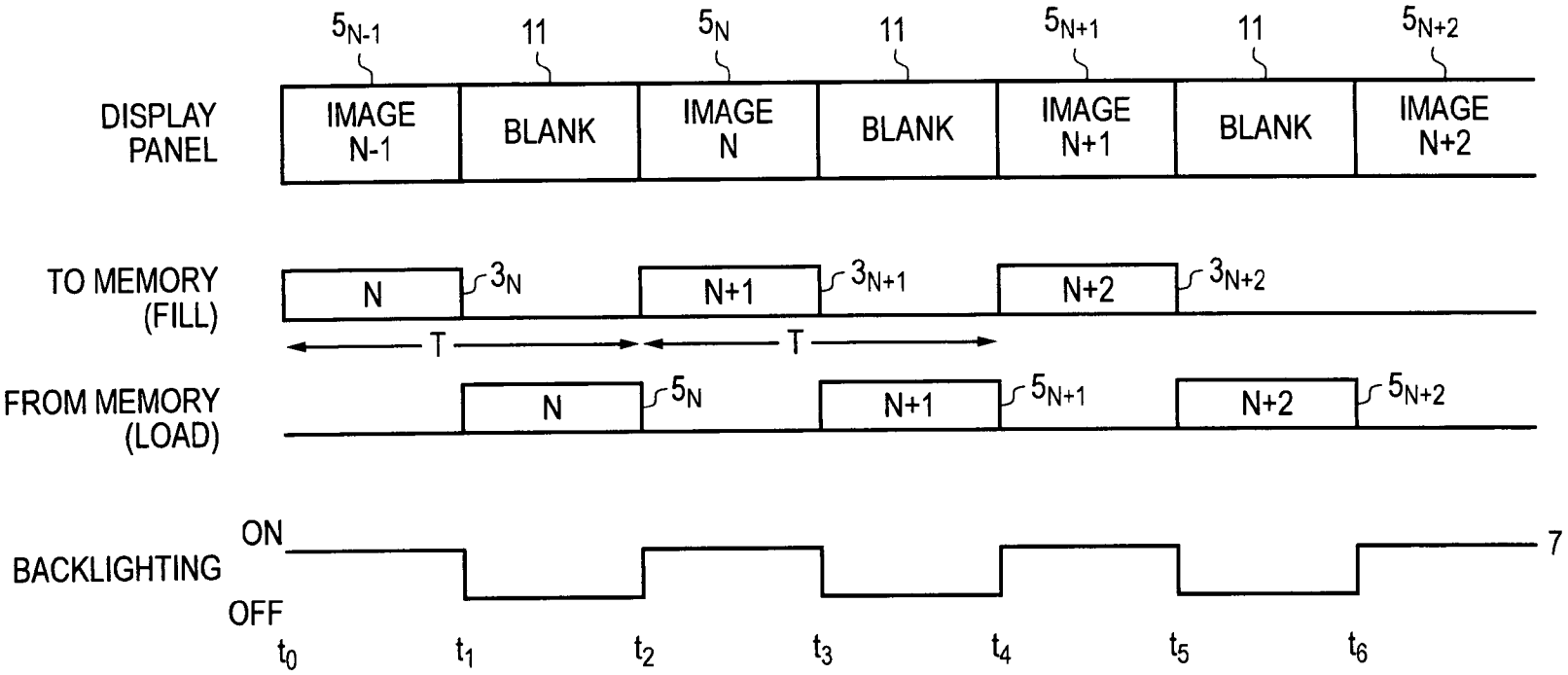
FIG. 2 schematically illustrates a timing diagram for the apparatus of FIG. 1.

Referring to FIGS. 1 and 2, the controller 2 has an interface to the frame memory 4 over which successive frames of data 3 are sent to fill the frame memory 4. In the illustrated example, the frames of data 3 are sent periodically every time period T. The frames of data 3 may be sent asynchronously and without flow control.

The frame memory 4 has an interface to the display panel 6 over which the successive frames of data stored in the frame memory 4 are loaded to the display panel 6 as frames for display 5. The frame of data for display 5 loaded to the display panel 6 is the same as the frame of data 3 previously sent by the controller 2 to fill the frame memory.

The frame memory 4 may operate as a first-in-first-out register. It may only have storage capacity for one frame of data. Alternatively it may have storage capacity for more than one frame of data.

The controller 2 is configured to insert blank frames 11 between frames of data 5 displayed on the display panel 6 using control signal 7. The blank frames in this example last T/2 and start at time t1+mT where m is an integer.

The frame memory 4 is configured to load a frame of data $\mathbf{5}_N$ to the display panel 6 during insertion of a blank frame 11 at the display panel 6.

Referring to FIG. 2, the frame of data $\mathbf{5}_N$ is loaded into the display panel 6 during the blank frame 11 between times t1 and t2. This blank frame 11 has a duration T/2. The frame of data $\mathbf{5}_N$ is displayed in the display panel 6 during the subsequent frame between times t2 and t3. This image frame has a duration T/2.

In the event that the frame memory 4 only has storage capacity for one frame of data, the frame of data $\mathbf{5}_N$ will need to be latched and held by the display panel 6 for display during the subsequent frame between times t2 and t3 and while the frame memory 4 is being filled with the next frame of data. The frame memory 4 loads its frame of data $\mathbf{5}_N$ to the display panel 6 within a time period of T/2 between t1 and t2 while the display panel 6 is blank 11. The frame memory 4 is filled with the next frame of data $\mathbf{3}_{N+1}$ within a time period of T/2 between t2 and t3 while the display panel 6 is displaying the frame of data $\mathbf{5}_N$. This tight timing schedule requires that the interface between the controller 3 and the frame memory 4 is fast and has a low latency. It also requires the interface between the frame memory 4 and the display panel 6 to be fast and have a low latency.

The controller 2 is configured to insert a blank frame 11 before each frame of data 5 is loaded to the display panel 6 and displayed by the display panel 6 using control signal 7. The controller 2 is configured to start insertion of a blank frame 11 at the same time or just before the frame memory 4 starts to load a frame of data 5 into the display panel 6.

As the frame memory 4 loads a frame of data 5 to the display panel 6 while the display panel 6 is blank, the frame memory 4 can start to load the frame of data 5 from any arbitrary start point within the frame of data 5 as it is not visible to a user during the blank frame.

Figure 3:
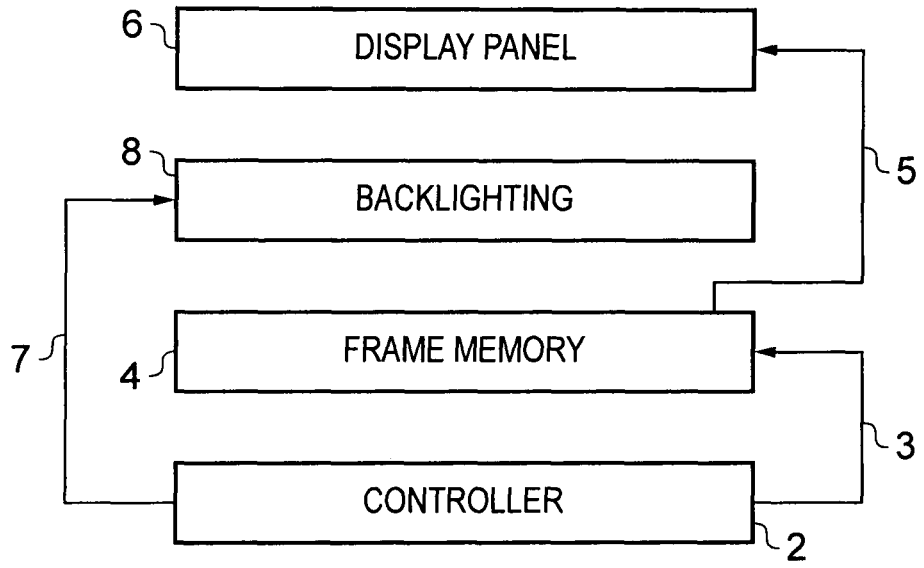
FIG. 3 schematically illustrates an apparatus configured to load a frame of data to a display panel during insertion of a black frame at the display panel.

FIG. 3 schematically illustrates an example of how the controller 2 may be configured to insert a blank frame 11. The controller 2 uses a control signal 7 to switch backlighting 8 to the display panel 6 on and off. The blank frame 11 is therefore a black or dark frame in which any data loaded into the display panel 6 is not visible.

In this example, the control signal 7 switches the backlighting 8 on and off. A suitable control signal 7 is illustrated in FIG. 2. The example of a control signal 7 in FIG. 2, has a programmable duty cycle (50% in this example) in which the backlighting 8 is off for T/2 between time t1+mT and t1+T/2+mT and in which the backlighting 8 is on for T/2 between time t1+T/2+mT and t1+T+mT, where m is an integer. In other examples, the duty cycle may be 30% on and 70% off, or the duty cycle may be any ratio of on to off time periods. This can depend on the type of display technology being deployed.

Figure 4:
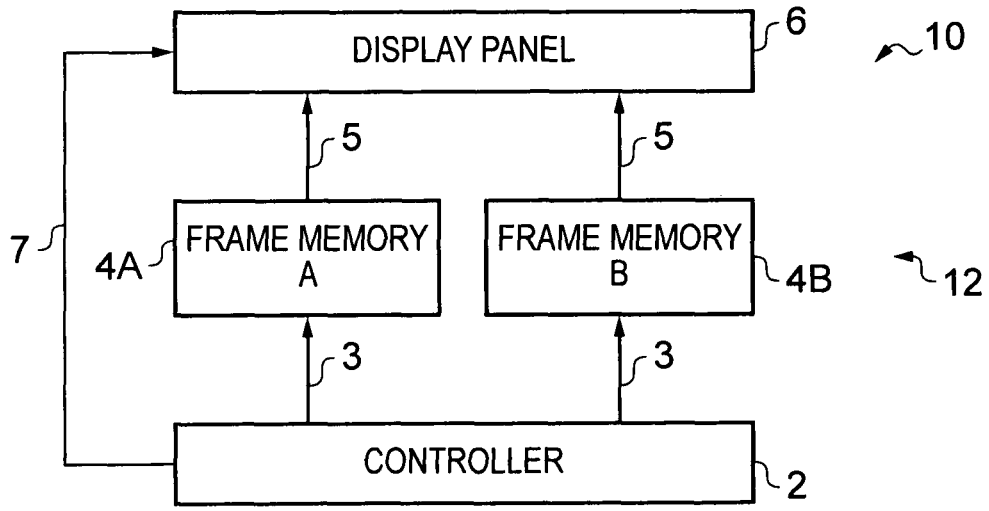
FIG. 4 schematically illustrates an apparatus, comprising a pair of frame memories, configured to load a frame of data to a display panel during insertion of a blank frame at the display panel.

FIG. 4 schematically illustrates an alternative example embodiment of the apparatus 10.

This embodiment is similar to the embodiment described with reference to FIG. 1 and may, optionally, use backlighting control as illustrated in FIG. 3. However, it comprises not only a first frame memory 4A but also a second frame memory 4B.

The controller 2 has an interface to the first frame memory 4A over which successive frames of data 3 are sent to fill the first frame memory 4A. In the illustrated example of FIG. 5, the frames of data 3 are sent periodically at time t1+m2T. The frames of data 3 may be sent asynchronously and without flow control.

The controller 2 has an interface to the second frame memory 4B over which successive frames of data 3 are sent to fill the second frame memory 4B. In the illustrated example of FIG. 5, the frames of data 3 are sent periodically at time t1+T+m2T. The frames of data 3 may be sent asynchronously and without flow control.

In this example, there is no significant latency or speed differential in or between the interfaces to the frame memories and the frames of data 3 are alternately loaded every T to either the first frame memory 4A or the second frame memory 4B.

The first frame memory 4A has an interface to the display panel 6 over which the successive frames of data stored in the first frame memory 4A are loaded to the display panel 6 as frames for display 5. The frame of data for display 5 loaded to the display panel 6 is the same as the frame of data previously sent by the controller 2 to fill the first frame memory 4A. The first frame memory 4A may operate as a first-in-first-out register. It may only have storage capacity for one frame of data. Alternatively it may have storage capacity for more than one frame of data.

The second frame memory 4B has an interface to the display panel 6 over which the successive frames of data stored in the second frame memory 4B are loaded to the display panel 6 as frames for display 5. The frame of data for display 5 loaded to the display panel 6 is the same as the frame of data previously sent by the controller 2 to fill the second frame memory 4B. The second frame memory 4B may operate as a first-in-first-out register. It may only have storage capacity for one frame of data. Alternatively it may have storage capacity for more than one frame of data.

The controller 2 is configured to insert blank frames 11 between frames of data 5 displayed on the display panel 6 using control signal 7. The blank frames in this example last T/2 and start at time t1+mT.

The first frame memory 4A is configured to load a frame of data 5 to the display panel 6 during insertion of a blank frame 11 at the display panel 6. The second frame memory 4B is also configured to load a frame of data 5 to the display panel 6 during insertion of a blank frame 11 at the display panel 6. However, the first frame memory 4A and the second frame memory 4B load data frames alternately to the display panel 6 as illustrated in FIG. 5.

Figure 5:
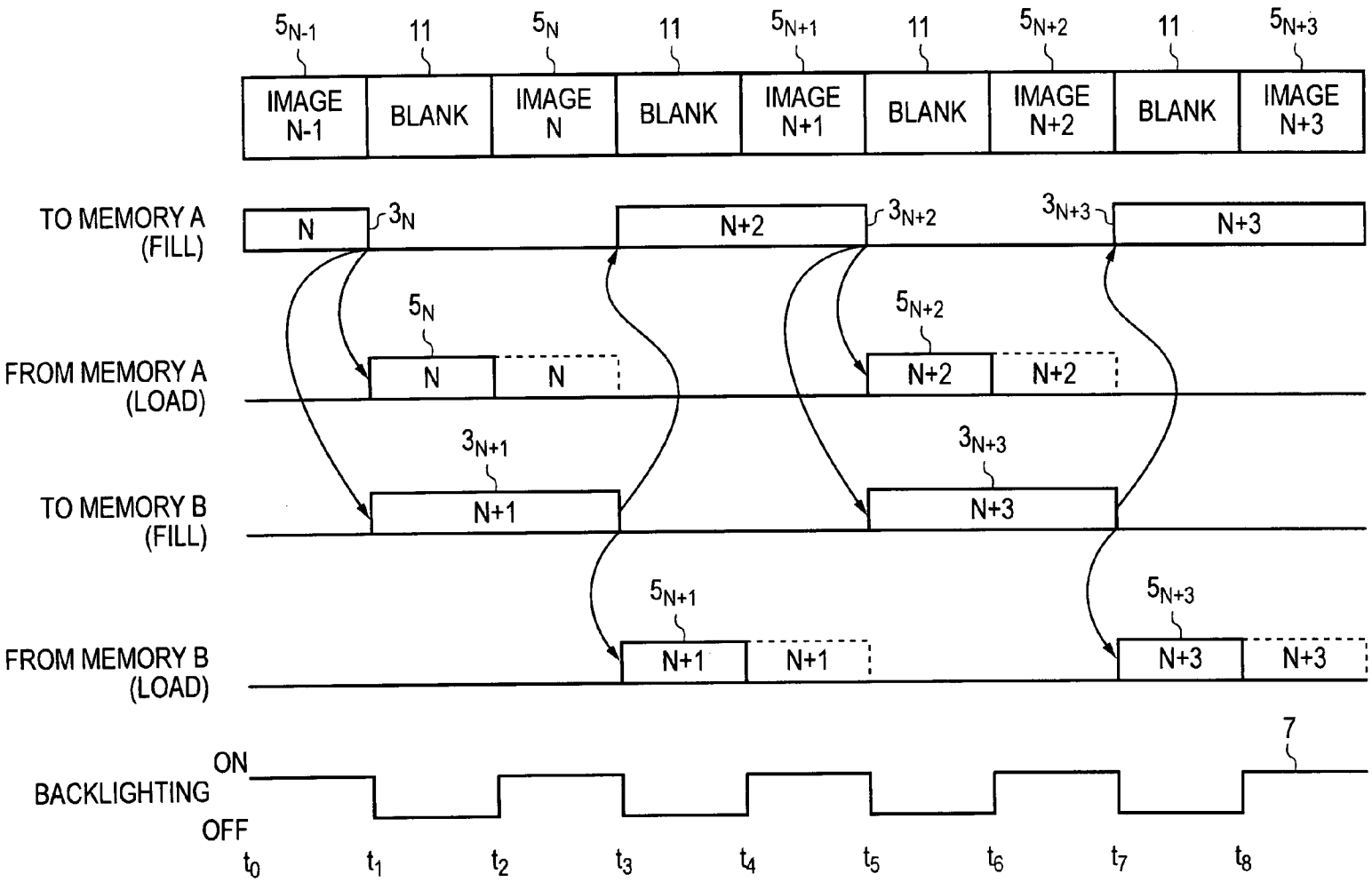
FIG. 5 schematically illustrates a timing diagram for the apparatus of FIG. 4.

Referring to FIG. 5, the frame of data $\mathbf{5}_N$ is loaded by the first frame memory 4A into the display panel 6 during the blank frame 11 between times t1 and t2. This blank frame has a duration T/2. The frame of data $\mathbf{5}_N$ is displayed in the display panel 6 during the subsequent frame between times t2 and t3. This image frame has a duration T/2.

The frame of data $\mathbf{5}_N$ may in some implementations be reloaded from the first frame memory 4A into the display panel 6 during the subsequent frame between times t2 and t3. This is illustrated using dotted lines.

The second frame memory 4B is filled with the next frame of data $3_{N+1}$ within a time period of T between t1 and t3 while the display panel 6 is blank and displaying the frame of data $5_N$.

The frame of data $5_{N+1}$ is loaded by the second frame memory 4B into the display panel 6 during the blank frame 11 between times t3 and t4. This blank frame has a duration T/2. The frame of data $5_{N+1}$ is displayed in the display panel 6 during the subsequent frame between times t4 and t5. This image frame has a duration T/2.

The frame of data $5_{N+1}$ may in some implementations be reloaded into the display panel 6 during the subsequent frame between times t4 and t5. This is illustrated using dotted lines.

The process is then repeated with subsequent frames of data.

The controller 2 is configured to start insertion of a blank frame 11 at the same time or just before a frame memory 4A, 4B starts to load a frame of data 5 into the display panel 6. As a frame memory 4A, 4B loads a frame of data 5 to the display panel 6 while the display panel 6 is blank, a frame memory can start to load a frame of data 5 from any arbitrary start point within the frame of data 5 as it is not visible to a user during the blank frame 11.

The controller 2 is configured to prevent the first frame memory 4A from being filled with an (N+2)th frame of data 5 from the controller 2 until the second frame memory 4B has been filled with a (N+1)th frame of data 5 from the controller 2.

The controller 2 is configured to prevent the second frame memory 4B from being filled with an (N+3)th frame of data 5 from the controller 2 until the first frame memory 4A has been filled with a (N+2)th frame of data 5 from the controller 2.

The controller 2 is configured to start filling a frame memory 4 at a beginning of a blank frame and to continue filling a frame memory 4 after blank frame 11. For example, the process of filling the second frame memory 4B with the frame of data $3_{N+1}$ starts at time t1 continues past t2 (t1+T/2) and ends before t3 (t1+T). The process of filling the first frame memory 4A with the frame of data $3_{N+2}$ starts at time t3 (t1+T) continues past t4 (t3+T/2) and ends before t5 (t3+T).

Figure 6:
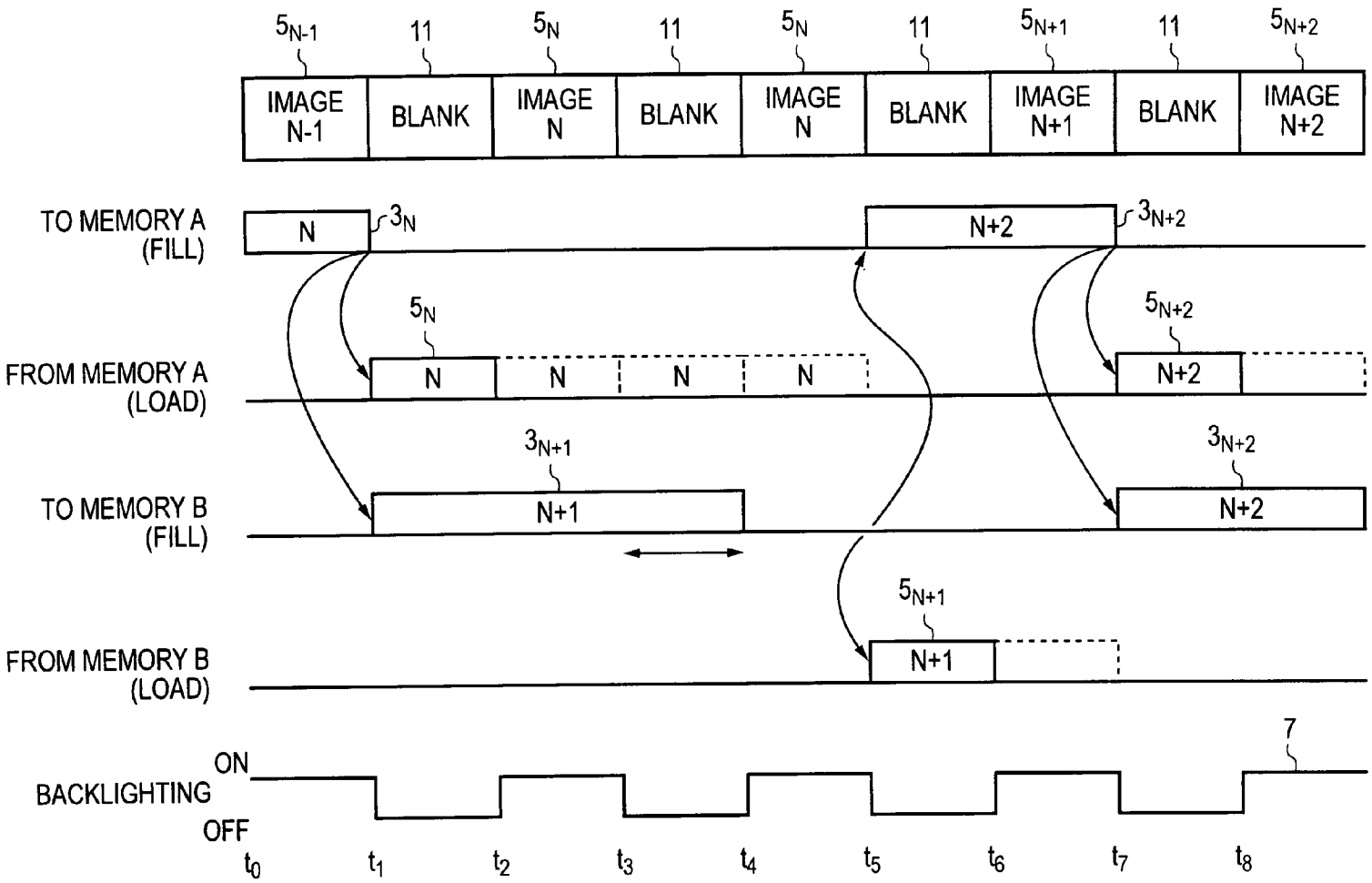
FIG. 6 schematically illustrates another timing diagram for the apparatus of FIG. 4.

FIG. 6 schematically illustrates an example embodiment of FIG. 5 in which the apparatus 10 is configured to deal with a delay in filling a frame memory 4.

In FIG. 6, there is a delay in completing the filling of the second frame memory 4B with the frame of data $3_{N+1}$. This may occur because, for example, of some latency in starting the filling process or some reduced speed in the filling process. However, at time t3 (t1+T), if the second frame memory 4B were to load its content to the display panel 6 it would be loading incomplete and erroneous data.

In some embodiments therefore, the loading of a frame of data 5 from the first frame memory 4A may be made conditional on the completion of the process of filling the second frame memory 4B with the next data frame. If this condition is not satisfied, the first frame memory 4A reloads its frame of data 5 to the display panel 6 for the next image frame. Likewise the loading of a frame of data from the second frame memory 4B may be made conditional on the completion of the process of filling the first frame memory 4A with the next data frame 5. If this condition is not satisfied, the second frame memory 4B reloads its frame of data 5 to the display panel 6 for the next image frame.

Referring back to FIG. 6, it can be seen that the delay in completing the process of filling the second frame memory 4B with the data frame $3_{N+1}$ results in the data frame $5_N$ being loaded to the display panel 6 not only between t1 and t3 but also between time t3 and t5.

Expressing this in a different way, the first frame memory 4A and the second frame memory 4B are configured to load a next frame of data, during insertion of a blank frame 11 at the display panel 6, from whichever of the first frame memory 4 and the second frame memory 4 was most recently filled with a complete frame of data 5 by the controller 2.

In FIG. 5, at time t3, the second frame memory 4B has been most recently filled with a complete frame of data $3_{N+1}$ by the controller 2 and the second frame memory 4B loads this data as the next frame of data $5_{N+1}$ to the display panel 6.

In FIG. 6, at time t3, the second frame memory 4B has not been the most recently filled with a complete frame of data by the controller 2 as it is still being filled with the frame of data $3_{N+1}$. The first frame memory 4A has been most recently filled with a complete frame of data $3_N$ by the controller 2 and the first frame memory 4A loads this data as the next frame of data $5_N$ to the display panel 6.

Referring back to FIGS. 1 and 4, the apparatus 10 may be formed from a display module 12 and the controller 2. In FIG. 1, the display module 12 comprises the display panel 6 and the frame memory 4. In FIG. 4, the display module 12 comprises the display panel 6 and a pair of frame memories 4 (the first frame memory 4A and the second frame memory 4B).

Figure 7:
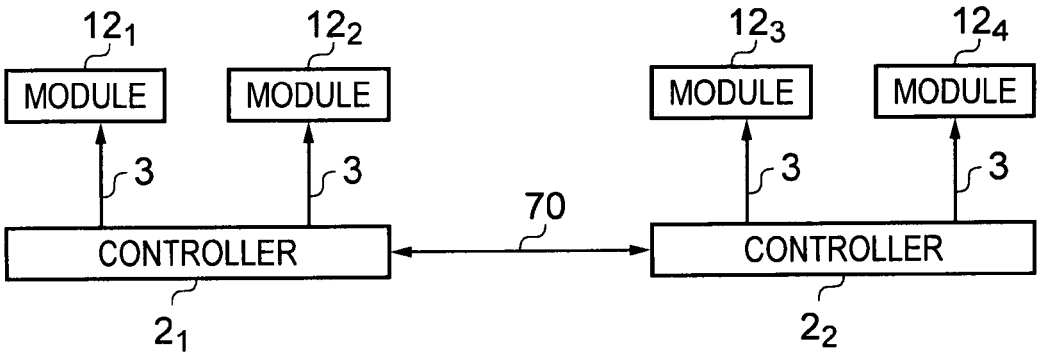
FIG. 7 schematically illustrates a controller controlling multiple display modules.

FIG. 7 schematically illustrates an apparatus or a system comprising multiple apparatus 10, in which a first controller $2_1$ controls a plurality of display modules $12_1$, $12_2$ and in which a second controller $2_2$ controls a plurality of display modules $12_3$, $12_4$. The control of the display modules 12 is as described in the preceding description.

The first controller $2_1$ is configured to synchronously insert, for each of the plurality of display modules $12_1$, $12_2$, a blank frame 11 between frames of data displayed on the display panels 6 of the display modules $12_1$, $12_2$. Synchronously inserting, for each of the plurality of display panels 6, a blank frame 11 between frames of data displayed on the display panels 6 may be achieved by synchronously switching-off backlighting 8 to the plurality of display panels 6.

The second controller $2_2$ is configured to synchronously insert, for each of the plurality of display modules $12_3$, $12_4$, a blank frame 11 between frames of data displayed on the display panels 6 of the display modules $12_3$, $12_4$. Synchronously inserting, for each of the plurality of display panels 6, a blank frame 11 between frames of data displayed on the display panels 6 may be achieved by synchronously switching-off backlighting 8 to the plurality of display panels 6.

Where two or more controllers 2 are used, they may need to have some synchronization 70 to ensure synchronous insertion, for each of the plurality of display modules $12_1$, $12_1$, $12_3$, $12_4$, of a blank frame 11 (not illustrated in FIG. 7) between frames of data displayed on the display panels 6.

Figure 8:
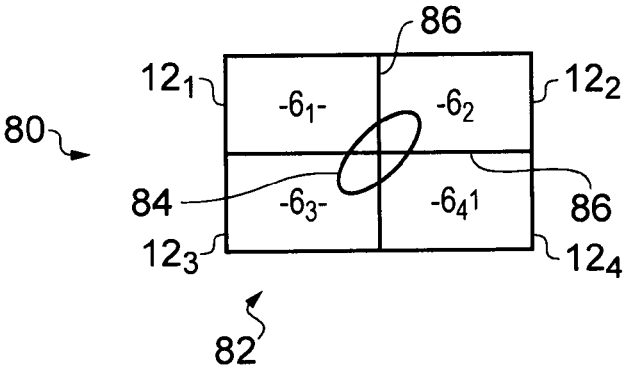
FIG. 8 schematically illustrates the use of multiple display modules in combination to display a moving image.

FIG. 8 schematically illustrates an arrangement 80 in which a plurality of rectangular display modules 12, such as those illustrated in FIGS. 1, 5 and 7 are arranged in a regular tessellated array so that their display panels 6 form a large display panel 82. The display modules 12 according to embodiments of the invention produce favorable results for displaying moving images 84 that move across the boundaries 86 between the display panels 6. In this example, the display modules $12_1$, $12_1$, $12_3$, $12_4$, synchronously insert a blank frame 11 between frames of data displayed simultaneously on the display panels 6 of the large display panel 82.

Figure 9:
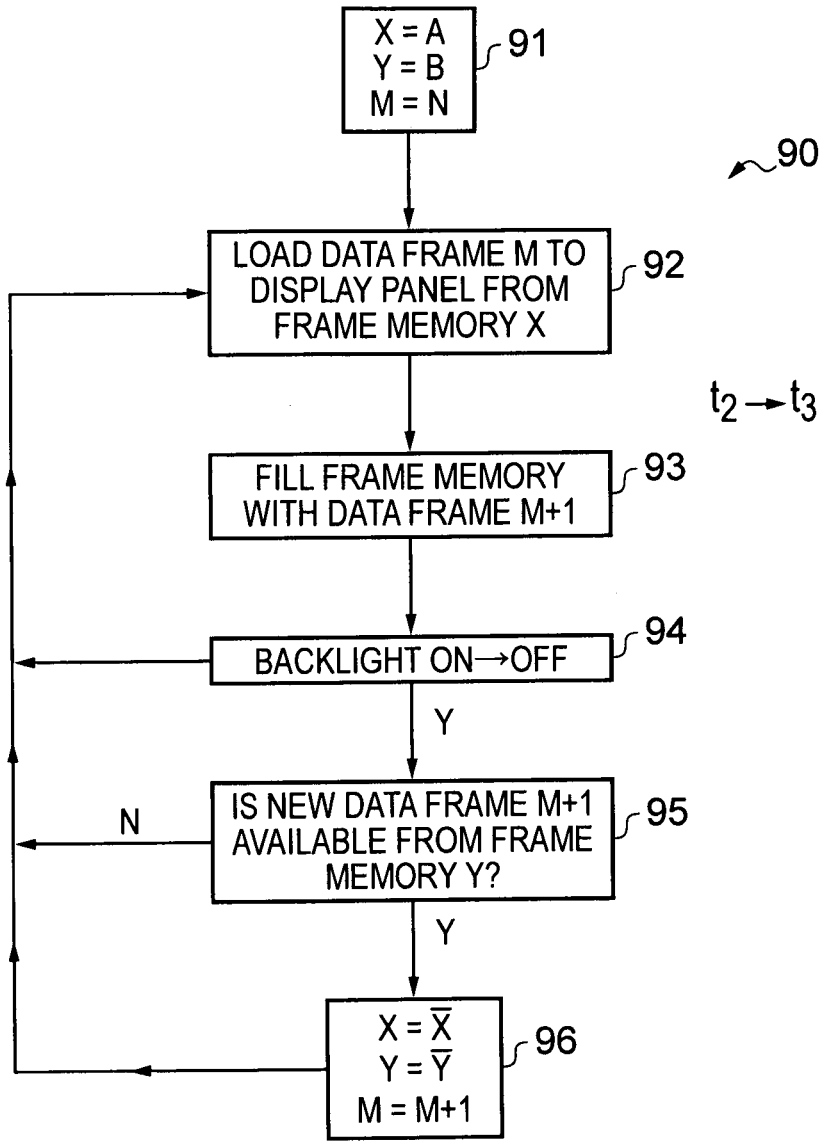
FIG. 9 schematically illustrates a method of operation for a display module comprising a pair of frame memories and a display panel.

FIG. 9 schematically illustrates a method 90 for controlling a display panel 6. This method may also be understood with reference to FIG. 6.

At block 91, some variables X, Y used for the concise description of the method are initialized. These variables are used to designate which of the first frame memory 4A and the second frame memory 4B are in use in the flowing blocks. Initially, the variable X relates to 'A' designating the first frame memory 4A and the variable Y relates to 'B' designating the second frame memory 4B. The frame counter M is initially set to N.

At block 92, the data frame $\mathbf{5}_N$ that has previously been loaded into the first frame memory 4A (as data frame $\mathbf{3}_N$) is loaded into the display panel 6.

At block 93, the second frame memory 4B is being filled by data frame $\mathbf{3}_{N+1}$.

The series of blocks 92, 93 are agnostic to whether the backlighting is on or off. The block 92 starts when the display panel 6 is blank but continues when it is in use e.g. the backlighting 8 is on and the data frame $\mathbf{5}_N$ is visibly displayed in the display panel 6.

At block 94 it is checked whether the backlighting has been turned from on to off. If the transition hasn't occurred (t2 in FIG. 6), the series of block 92, 93 repeats. If the transition has occurred (t3 in FIG. 6), the method 90 moves to block 95.

At block 95 it is determined whether or not the second frame memory 4B has been filled by the data frame $\mathbf{3}_{N+1}$ which would then be available as a new frame of data $\mathbf{5}_{N+1}$ from the second frame memory 4B.

If no, the method returns to block 92 and the series of blocks 92, 93 is repeated until the backlighting is again turned from on to off (t5 in FIG. 6). Consequently, the frame of data $\mathbf{5}_N$ is re-used in the display panel 6 as the frame of data $\mathbf{5}_{N+1}$ is not yet ready for use.

If the new frame of data $\mathbf{5}_{N+1}$ is available from the second frame memory 4B, then the method moves to block 96.

At block 96, the variables X, Y are swapped so that the variable Y relates to 'A' designating the first frame memory 4A and the variable X relates to 'B' designating the second frame memory 4B. The frame counter M also increases by one. The method then moves to block 92.

At block 92, the data frame $\mathbf{5}_{N+1}$ that has previously been loaded into the second frame memory 4B is loaded into the display panel 6.

At block 93, the first frame memory 4A is being filled by data frame $\mathbf{3}_{N+2}$.

The series of steps 92, 93 are agnostic to whether the backlighting is on or off. They start following the transition of the backlight 8 from on to off at the beginning of a blank frame (t5 in FIG. 6). They continue when the display panel 6 is in use e.g. the backlighting is on and the data frame $\mathbf{5}_{N+1}$ is visibly displayed in the display panel 6.

At block 95 it is determined whether or not a new frame of data $\mathbf{5}_{N+2}$ is available from the first frame memory 4A.

If no, the method 90 returns to block 92 and the series of blocks 92, 93 is repeated until the backlighting 8 is again turned from on to off. Consequently, the frame of data $\mathbf{5}_{N+1}$ is re-used in the display panel as the frame of data $\mathbf{5}_{N+2}$ is not yet ready for use.

If the new frame of data $\mathbf{5}_{N+2}$ is available from the first frame memory 4A, then the method moves to block 96 (t7 in FIG. 6).

At block 96, the variables X, Y are swapped so that the variable X relates to 'A' designating the first frame memory 4A and the variable Y relates to 'B' designating the second frame memory 4B. The frame counter M also increases by one. The method 90 then moves to block 92.

The method 90 therefore uploads frames of data from the frame memories to the display panel during a blank frame of the display panel 6. In the next frame, the display panel displays the uploaded frame.

The method only starts to fill one frame memory after it has checked that it can upload a complete frame of data from the other frame memory.

The interface between the frame memory and the display panel in some embodiments is at least twice as fast as the interface between the controller 2 and frame memory.

Implementation of a controller 2 can be in hardware alone (a circuit, a processor . . . ), have certain aspects in software including firmware alone or can be a combination of hardware and software (including firmware).

The controller 2 may be implemented using instructions that enable hardware functionality, for example, by using executable computer program instructions in a general-purpose or special-purpose processor that may be stored on a computer readable storage medium (disk, memory etc) to be executed by such a processor.

The computer program may arrive at the apparatus via any suitable delivery mechanism. The delivery mechanism may be, for example, a computer-readable storage medium, a computer program product, a memory device, a record medium such as a CD-ROM or DVD, an article of manufacture that tangibly embodies the computer program. The delivery mechanism may be a signal configured to reliably transfer the computer program. The apparatus may propagate or transmit the computer program as a computer data signal.

Although the memory is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used here 'module' refers to a unit or apparatus that excludes certain parts/components that would be added by an end manufacturer or a user.

The blocks illustrated in the FIG. 9 may represent steps in a method and/or sections of code in the computer program. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. Apparatus comprising:

a controller;

a display panel;

a first frame memory configured to load a frame of data to the display panel during insertion of a blank frame at the display panel and configured to be filled by a frame of data from the controller; and a second frame memory, different from the first frame memory, configured to load a frame of data to the display panel during insertion of a blank frame at the display panel and configured to be filled by a frame of data from the controller, wherein the controller is configured to insert a blank frame between two frames of data displayed on the display panel and wherein the first frame memory is configured to reload a first frame of data, displayed at the display panel for a first image frame, to the display panel for a second image frame when a process of filling the second frame memory with a second frame of data is not completed.

2. Apparatus as claimed in claim 1, wherein the controller is configured to insert a blank frame after each frame of data is loaded to the display panel and displayed by the display panel.

3. Apparatus as claimed in claim 1, further comprising a backlighting element configured to provide backlighting for the display panel controlled by the controller;

wherein the controller is configured to insert the blank frame between the two frames of data displayed on the display panel by temporarily switching off the backlighting element for the duration of the blank frame.

4. Apparatus as claimed in claim 3, wherein the controller is configured to switch the backlighting element on and off with a programmable duty cycle.

5. Apparatus as claimed in claim 1, wherein the controller is configured to start insertion of a blank frame at the same time or just before the first frame memory or the second frame memory starts to load a frame of data into the display panel.

6. Apparatus as claimed in claim 1, wherein the first frame memory or the second frame memory is configured to load a frame of data from an arbitrary point in the first frame memory or the second frame memory, respectively.

7. Apparatus as claimed in claim 1, wherein the first frame memory and the second frame memory are configured to be alternately filled by frames of data from the controller and are configured to alternately load a new frame of data to the display panel.

8. Apparatus as claimed in claim 1, wherein the first frame memory and the second frame memory are configured to load a next frame of data from whichever of the first frame memory and the second frame memory was most recently filled with a frame of data by the controller.

9. Apparatus as claimed in claim 8, wherein the next frame of data is the most recently filled frame of data.

10. Apparatus as claimed in claim 1, wherein the controller is configured to start filling the first frame memory or the second frame memory at a beginning of a blank frame.

11. Apparatus as claimed in claim 1, wherein the controller is configured to continue filling the first frame memory or the second frame memory after a blank frame.

12. Apparatus as claimed in claim 1, wherein an interface between the controller and the first and the second frame memories is asynchronous.

13. Apparatus as claimed in claim 1, further comprising a plurality of display panels, wherein each display panel has an associated first frame memory and an associated second frame memory, wherein each of the associated first frame memory and the associated second frame memory is configured to be filled by a frame of data from the controller and configured to load a frame of data to an associated display panel during insertion of a blank frame at the associated display panel, and wherein the controller is configured to synchronously insert, for each of the plurality of display panels, a blank frame between frames of data displayed on the display panels.

14. Apparatus as claimed in claim 13, wherein synchronously inserting, for each of the plurality of display panels, a blank frame between frames of data displayed on the display panels is achieved by synchronously switching-off backlighting to the plurality of display panels.

15. Apparatus as claimed in claim 13, wherein the plurality of display panels in combination display an image that moves across multiple ones of the plurality of display panels.

16. Apparatus as claimed in claim 1, wherein at least one of: an interface between the first frame memory and the display panel is at least twice as fast as an interface between the controller and the first frame memory, and an interface between the second frame memory and the display panel is at least twice as fast as an interface between the controller and the second frame memory.

17. An apparatus as claimed in claim 1, wherein the second frame memory is configured to reload a third frame of data, displayed at the display panel for a third image frame, to the display panel for a fourth image frame when a process of filling the first frame memory with a fourth frame of data is not completed.

18. An apparatus comprising:

one or more display modules, each display module comprising:

a display panel;

a first frame memory configured to be filled by a frame of data from an input interface and configured to load a frame of data to the display panel; and a second frame memory configured to be filled by a frame of data from an input interface and configured to load a frame of data to the display panel, wherein the first and second frame memories are configured so that whichever of the first frame memory and the second frame memory that has been most recently filled by a complete frame of data, loads a next frame of data to the display panel and wherein each display module is configured to load a frame of data only during insertion of a blank frame; and one or more controllers, each controller configured to synchronously insert, for each of the display modules, a blank frame between frames of data displayed on the display panel, wherein the first frame memory is configured to reload a first frame of data, displayed at the display panel for a first image frame, to the display panel for a second image frame when a process of filling the second frame memory with a second frame of data is not completed.

19. A method comprising:

displaying a first frame of data previously loaded into a display panel from a first frame memory;

reloading, from the first frame memory, the first frame of data, displayed at the display panel for a first image frame, to the display panel for a second image frame when a process of filling a second frame memory with a second frame of data is not completed;

displaying a blank frame at the display panel and simultaneously loading the second frame of data into the display panel from the second frame memory; and displaying the second frame of data previously loaded into the display panel from the second frame memory.

* * * * *